US006385870B1

(12) United States Patent
Webel et al.

(10) Patent No.: US 6,385,870 B1
(45) Date of Patent: May 14, 2002

(54) CONTROL SYSTEM FOR AN EXCAVATOR THUMB AND A METHOD OF CONTROLLING AN EXCAVATOR THUMB

(75) Inventors: Roger A. Webel, Copley; Salvatore L. Zingales, Sr., Westlake, both of OH (US)

(73) Assignee: NPK Construction Equipment, Inc., Walton Hills, OH (US)

( * ) Notice: Subject to any disclaimer, the term of this patent is extended or adjusted under 35 U.S.C. 154(b) by 0 days.

(21) Appl. No.: 09/899,387

(22) Filed: Jul. 6, 2001

(51) Int. Cl.[7] ..... E02F 3/96
(52) U.S. Cl. ..... 37/406; 37/466; 701/50
(58) Field of Search ..... 37/406, 466; 701/50; 172/2, 830

(56) References Cited

U.S. PATENT DOCUMENTS 4,332,254 A * 6/1982 Lundquist ..... 128/344

* cited by examiner

*Primary Examiner*—Christopher J. Novosad
(74) *Attorney, Agent, or Firm*—Vickers, Daniels & Young

(57) ABSTRACT

A control system and method of using a control system for a thumb on an excavator allows the thumb to follow a workpiece held in a bucket when the bucket moves. The thumb control circuit is activated by the press of a button and thereafter maintains a constant reduced close fluid pressure of the extend port of the thumb cylinder until the open control is actuated.

19 Claims, 3 Drawing Sheets

CONTROL SYSTEM FOR AN EXCAVATOR THUMB AND A METHOD OF CONTROLLING AN EXCAVATOR THUMB

TECHNICAL FIELD

This invention relates to a control system for a hydraulically operated excavator thumb and a method of controlling the excavator thumb.

BACKGROUND OF THE INVENTION

Construction equipment is used to perform a variety of tasks on construction sites, demolition sites, in scrap yards, in road work, in mines, in railroad maintenance, and in other applications. Versatility is often an important feature to a person using such equipment. Construction equipment used in these areas includes excavators, backhoes, and other well-known pieces of equipment. With respect to excavators and backhoes, a common configuration comprises a tractor portion carrying a boom which in turn carries a stick. The stick carries any of several implements. One common implement is a bucket used in excavating. An operator sits on the tractor portion of the backhoe or excavator and uses control levers to control various hydraulic cylinders moving the boom, stick and bucket. In this configuration, the excavator or backhoe is used to excavate holes, trenches and the like. Some object lifting can be done in this configuration by picking up an object in the bucket or by attaching an object to the bucket by means of chains or the like.

Some operators of excavators and backhoes attach a thumb to the stick. The thumb is controlled by a hydraulic cylinder allowing the thumb to be pivoted around an attachment point to close against the excavator bucket. This allows one to position the bucket against a workpiece to be lifted and close the thumb against the workpiece. The workpiece is held and moved as desired by moving the boom and stick. The thumb holds the workpiece against the bucket as a person's thumb can hold an object against the palm of the hand. While this thumb arrangement has advantages, it also has significant limitations. If one moves the bucket away from the thumb while engaged to a workpiece, the piece may be dropped. Moving the bucket and thumb together with the workpiece retained is not easy. The geometry of how the cylinders work on the bucket and the thumb are often different. If the cylinders are both extended the same amount, the thumb may move a different angular distance than the bucket. Moreover, this geometry sometimes changes over the stroke of the cylinders. Additionally, the diameter of the bucket cylinder and thumb cylinder are often different. Therefore the cylinders may extend or retract at different rates given the same flow of hydraulic fluid. Thus, the conventional control systems for a thumb and bucket used on an excavator are far from ideal.

SUMMARY OF THE INVENTION

In accordance with the present invention, there is provided a control system for an excavator thumb in which a thumb close switch is depressed causing a hydraulic fluid at a select close pressure to be applied to the cylinder closing the thumb. This select close pressure is automatically maintained closing the thumb against the bucket or a workpiece.

Further in accordance with the invention, the thumb close switch is latched so that the selected closed pressure will be maintained until a thumb open switch is activated.

Still further in accordance with the invention, a thumb control circuit is provided for an excavator in which a thumb is mounted opposable to a bucket and controlled by a thumb cylinder. The thumb cylinder is actuated by a latching switch in the close direction and a non-latching switch in the open direction which switches control valves directing fluid to the thumb cylinder. Fluid directed to the thumb cylinder when the close switch is latched is passes through a pressure reducing valve delivering fluid at a selected lower pressure and maintaining this pressure until the close switch is unlatched.

Still further in accordance with the invention, a control for a thumb on an excavator is provided with bypass valves allowing one to remove the thumb and use the hydraulic circuits otherwise controlling the thumb in other applications, such as driving an impact hammer.

Still further in accordance with the invention, a control for a hydraulic thumb on an excavator is provided requiring operator input only to change state.

It is the principal object of the present invention to provide a control system for an excavator thumb which is robust, easy to use, versatile, and easily installed.

It is another object of the present invention to provide a control for an excavator thumb which will automatically close upon a workpiece at the press of a button.

It is yet another object of the present invention to provide a control system for an excavator thumb which will close upon a workpiece using a preset reduced fluid pressure and maintain this pressure until disengaged by the operator.

It is still another object of the present invention to provide a control system for a thumb on an excavator which will hold the workpiece against the bucket using a selected cylinder fluid close pressure and maintain this pressure when an operator moves the bucket.

It is still another object of the present invention to provide a control system for an excavator thumb including bypasses allowing one to use the hydraulic circuit for implements other than the thumb without removal of the thumb control mechanism.

It is still another object of the present invention to provide a control system for an excavator thumb in which the thumb can be disengaged from a workpiece and easily moved to a desired disengaged position.

It is still another object of the present invention to provide a control system for an excavator thumb in which the thumb, when activated, will hold a workpiece against the bucket and follow the bucket through curl and uncurl movements.

It is yet another object of the present invention to provide a thumb control circuit which is inexpensive, easy to install, easy to use and uses existing excavator control components.

It is yet another object of the present invention to provide a control system for an excavator thumb using electrical switches in the operator cab to control the thumb thereby easing installation.

It is yet another object of the present invention to provide a method of controlling a thumb on an excavator allowing an operator to easily grasp a workpiece between a bucket and the thumb and maintain a positive grip on the workpiece automatically during manipulation of the bucket.

It is yet another object of the present invention to provide a method of controlling an excavator thumb which is automatic.

It is still another object of the present invention to provide a method for controlling a thumb which is easy to use in that once the thumb is engaged, operator control becomes unnecessary.

It is another object of the present invention to provide a method of controlling an excavator thumb which is easily disengaged allowing an operator to positively position the thumb in a disengaged position.

It is yet another object of the present invention to provide a control system for an excavator thumb which is easily maintained in the field, robust, not prone to failure, and has only minimal moving parts.

BRIEF DESCRIPTION OF THE DRAWINGS

The foregoing objects, and others, will in part be obvious and in part pointed out more fully hereinafter in conjunction with the written description of the preferred embodiment of the invention illustrated in the accompanying drawings in which.

DESCRIPTION OF THE PREFERRED EMBODIMENT

Figure 1:
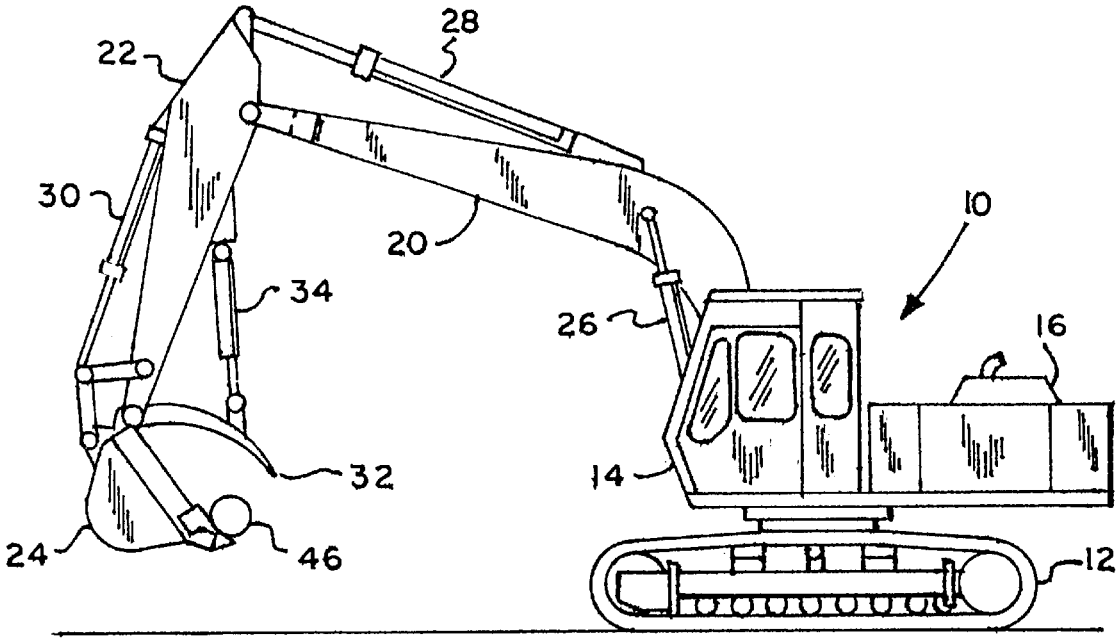
FIG. 1 is a side elevation view of a hydraulic excavator having a thumb opposed to a bucket.

Referring now in greater detail to the drawings, wherein the showings are for the purpose of illustrating a preferred embodiment of the invention and not for the purpose of limiting the invention, FIG. 1 shows an excavator 10. The excavator 10 is self-propelled and movable upon tracks 12. An operator cab 14 and a diesel engine or the like 16 are mounted above the tracks 12 and rotatable with respect to the tracks 12. A boom 20 is mounted on the excavator 10 rotating with the cab 14. A stick 22 is mounted at the end of the boom 20 and in turn supports a bucket 24. The diesel engine 16 drives a hydraulic pump (not shown) in the engine compartment which supplies high pressure hydraulic fluid to a hydraulic system. The hydraulic system is used to actuate a boom cylinder 26, a stick cylinder 28, and an implement cylinder 30. This structure is conventional. Excavators as described above are available from a number of different manufacturers. Moreover, similar structures are found on smaller pieces of equipment such as backhoes. Excavators and backhoes often have provisions for mounting implements other than buckets. These provisions include auxiliary valves and the like allowing an operator to remove a bucket and add implements such as vibratory compactors, impact hammers, and other specialized equipment.

Excavators often have provisions which allow one to mount a thumb 32 pivotally at the end of the stick 22. The thumb 32 pivots in the same volume of space in which the bucket 24 pivots. The thumb 32 opposes the bucket in a manner similar to the way the thumb on one's hand opposes the palm. A thumb cylinder 34 is fixed at one end to the stick 22 and at the other end to the thumb 32. The thumb cylinder 34 piston rod extends and retracts positioning the thumb and engaging the bucket or a workpiece 46 held against the bucket. One conventional way to operate a thumb through the cylinder 34 uses a lever control in the cab 14 of the excavator. The lever manually controls the flow of hydraulic fluid to the extend and retract ports of the thumb cylinder 34. An operator positions the bucket 24 adjacent to or under a workpiece 46 and then use the thumb control lever to bring the thumb 32 against the workpiece. The boom and stick will then move to position the workpiece as desired. If the bucket 24 is to be moved, the operator manually maintains the thumb 32 against the workpiece by use of the manual control.

Figure 4:
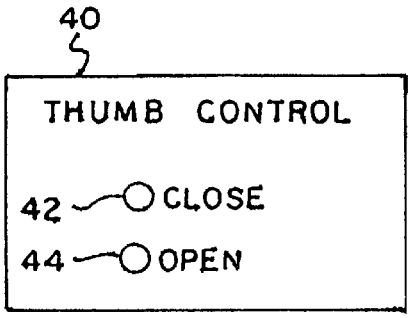
FIG. 4 is an illustration of a control panel positioned in the operator cab used to control the control system of FIG. 2 and hence the thumb of FIG. 1; and, FIG. 5 is an alternate control panel usable in place of the control panel of FIG. 4.
Figure 3:
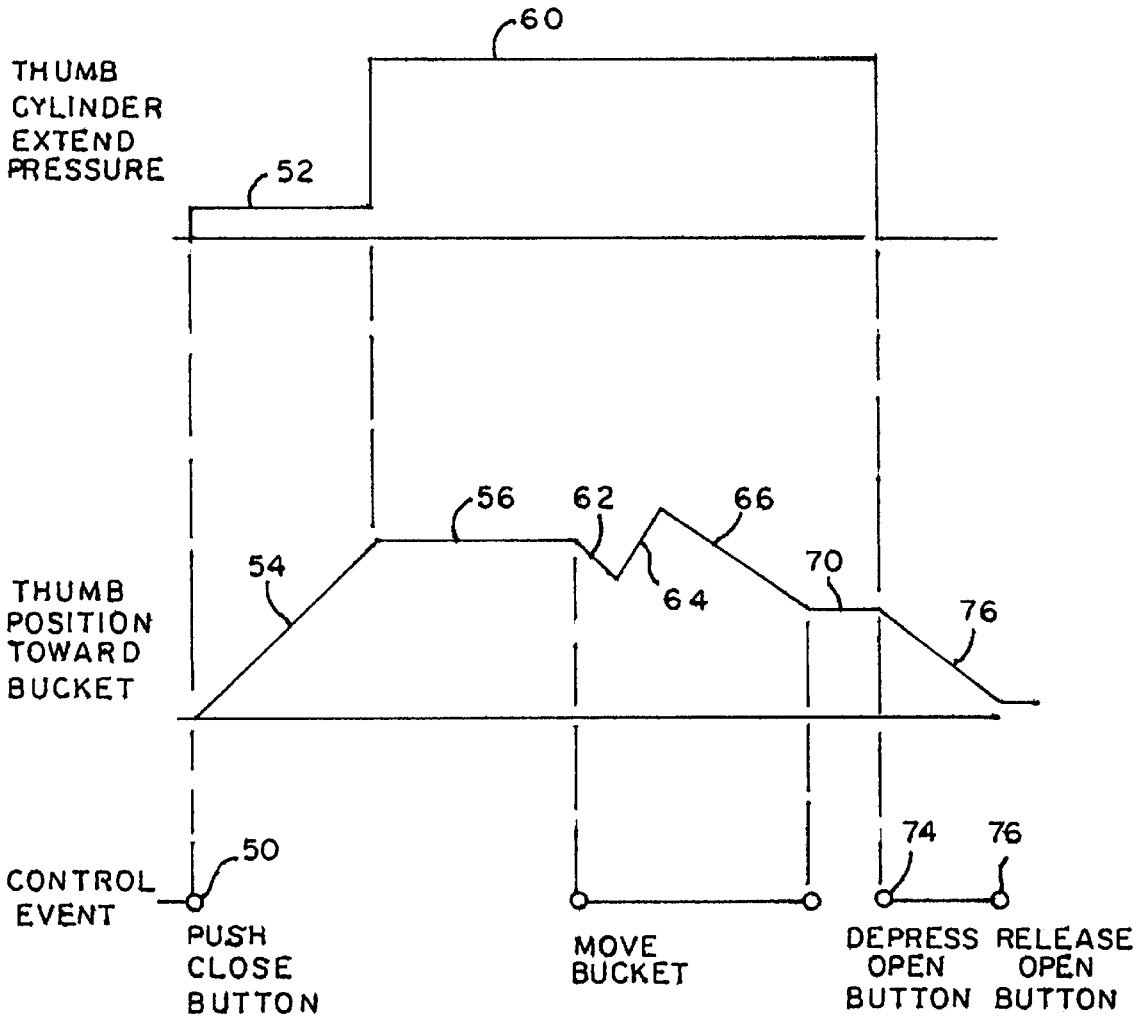
FIG. 3 is a diagram illustrating the relationship between control events, thumb position, and hydraulic pressure.

In accordance with the present invention, FIG. 4 illustrates a control panel 40 for the thumb control of the present invention. The operator interface consists of two buttons, a close button 42 and an open button 44. The operator controls the thumb 32 by depressing one of the buttons 42, 44. No other controls for the thumb 32 are needed in the cab 14. The operation of the thumb control 40 and the thumb 32 are discussed below with reference to FIG. 3 showing graphically idealized responses to control events at the thumb control 40.

Figure 2:
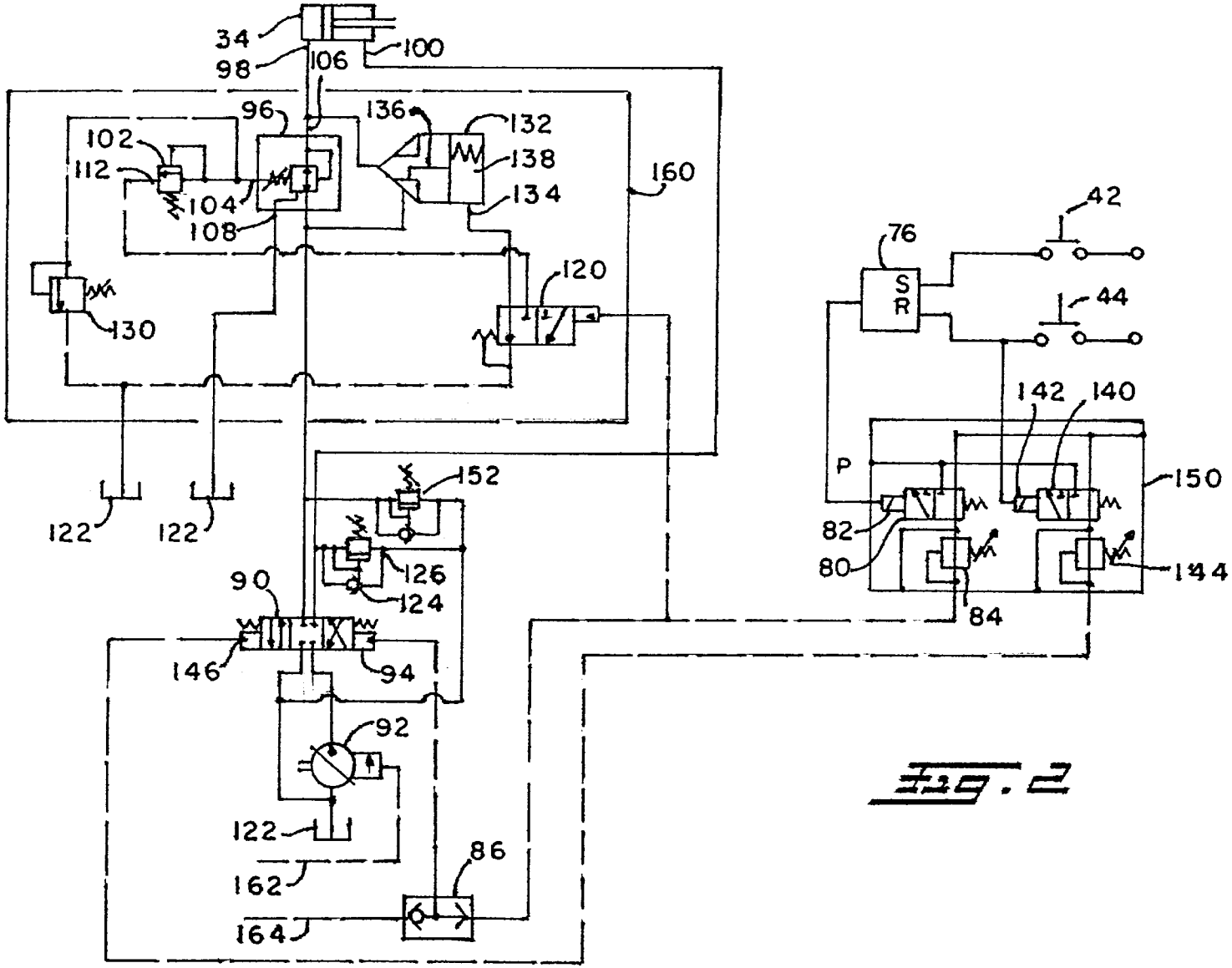
FIG. 2 is a schematic presentation of the control system for the thumb on the excavator of FIG. 1.

An operator can position the bucket 24 adjacent the workpiece 46. With the workpiece positioned, the operator may wish to close the thumb 32 to grasp the workpiece 46. The operator momentarily depresses the close button 42. This is shown as the push close button point 50 in FIG. 3. This action starts the flow of hydraulic fluid to the thumb cylinder extend port. As seen at the top of FIG. 3, a relatively low positive pressure is created in the thumb cylinder 34 at 52. This causes the thumb 32 to move toward the bucket as shown in the thumb position toward bucket portion of the graph. This movement is shown as a constant slope 54 as the thumb closes on the workpiece 46. When the thumb 32 engages the workpiece, its motion stops. This is shown by the horizontal line 56 in the thumb position portion of FIG. 3. At the point where the workpiece 46 is contacted, thumb cylinder extend pressure rapidly rises to a selected thumb cylinder close pressure 60. The selected thumb cylinder close pressure is substantially below maximum system pressure. In the preferred embodiment, it is selected to be 2300 psi. This pressure is selected to provide adequate holding power for a normal workpiece without crushing the workpiece 46. Of course different selected thumb cylinder close pressures 60 could be set for different work environments. As can be seen at the top of FIG. 3, the thumb cylinder extend pressure is held at the selected thumb cylinder close pressure after the workpiece is first gripped. This remains the case while the thumb position is constant shown in the horizontal segment 56 and also should the operator move the bucket 24 by curling it inwardly toward the cab as shown in segment 62, outwardly away from the cab as shown in segment 64 and again inwardly toward the cab as shown in segment 66. Curling motion moving the bucket 24, thumb 32 and workpiece 46 may be necessary to properly position the workpiece on a truck bed in a trench or in any other desired or convenient location. The thumb 32 is held against the workpiece 46 as the thumb cylinder extend pressure remains constant during these movements. The thumb cylinder 34 extends and retracts as necessary without operator intervention because the pressure in the extend portion of the thumb cylinder 34 is held constant. Fluid is added or drained as required. After the workpiece 46 is positioned as desired, a short interval of no bucket motion 70 is followed by the operator releasing the workpiece 46. This is done by depressing the thumb control open button 44 as shown as point 74 in FIG. 3. This action immediately releases pressure at the thumb cylinder extend port. While the open button is depressed, high pressure hydraulic fluid is applied to the thumb cylinder retract port causing the thumb 32 to move away from the workpiece 46 as shown by the sloped line 76 in FIG. 3. When the operator releases the open button 44 as shown at point 76 in FIG. 3, the thumb 32 ceases movement at its then current location. Should the operator wish to move the thumb 32 further away from the bucket 24, he need only to press and hold the open button 44 until the movement is achieved. Thus, automatic control of the thumb 32 is provided. When the close button 42 is pressed, the thumb 32 will close upon a workpiece 46 or the bucket 24 and hold its engagement against the workpiece 46 or the bucket 24 until the open button 44 is pressed. This engagement relative to the bucket 24 will be maintained even when the bucket 24 is moved relative to the stick 22. The control system for achieving this result is illustrated in FIG. 2.

The thumb close switch 42 is a momentary contact switch. Momentarily depressing the close button 42 applies a signal to the set input S of a latching relay 76 or equivalent solid state electronic device 76. When the signal is applied to the S input of the relay 76, the output is energized and stays energized even after the thumb close button 42 is released. The output of the relay 76 is applied to the solenoid 82 of a solenoid controlled pilot valve 80. With the solenoid 82 actuated, pilot pressure fluid available at the P input is passed through the solenoid controlled pilot valve 80 to an adjustable pressure control valve 84. Thus, hydraulic fluid at pilot pressure, (less than full operating level pressure) flows to the pressure control valve 84. The pressure control valve 84 reduces the pressure of the hydraulic fluid to a controlled pressure and its output is connected through a check valve 86 to a first pilot input 94 of a 3-position, 4-way pilot operated spool valve 90. With controlled pressure fluid applied through the check valve 86, the spool valve 90 directs the output of a pump 92 into a pressure reducing spool valve 96. Normal system pressure at the output of the pump 92 is typically in the neighborhood of 5,000 psi. The output of the pressure reducing spool valve 96 is maintained at the selected thumb cylinder close pressure previously discussed. This pressure is adjustable, in the preferred embodiment, it is set to 2,300 psi. The output of the pressure reducing spool valve 96 is applied to the extend port 98 of the thumb cylinder 34.

The pressure reducing spool valve 96 is controlled by a pilot relief valve 102. The pilot relief valve 102 is adjustable and is set to maintain 2,300 psi at its input which is connected to the control port 104 of the pressure reducing spool valve 96. Setting the relief pressure of the pilot relief valve 102 sets the regulating output pressure of the pressure reducing spool valve 96. The pressure reducing spool valve 96, while actuated, will maintain the pressure at its output port 106 and hence the thumb cylinder extend port 98 at the selected thumb cylinder close pressure. The pressure reducing spool valve 96 throttles flow from the pump 92 and, if necessary, closes off the pump 92 from output port 106. The pump controls 162 will regulate the flow to a minimum or other mechanism will minimize the flow automatically. This mechanism will vary from excavator to excavator. A port to tank 108 is provided but only used if regulated pressure at the output port 106 rises significantly over the preset pressure. The port 108 does not relieve the input.

The drain 112 of the pilot relief valve 102 communicates with a pilot operated 3-way valve 120 which is controlled by the solenoid controlled pilot valve 80 and pressure control valve 84 previously discussed. With the solenoid 82 actuated, the 3-way valve 120 connects the drain 112 of the pilot relief valve 102 to the tank 122, allowing it to operate as described above. Thus, pressure at the output 106 of the pressure reducing spool valve 96 is maintained at the preset 2300 psi. This will close the thumb 32 on a workpiece 46 and hold it there as illustrated in FIG. 3. Should the bucket curl inwardly toward the thumb 32, fluid will be vented through the extend port 98, the pressure reducing spool valve 96, the tank port 108 to the tank or reservoir 122. When the bucket 24 curls away from the thumb as illustrated in segment 66 of FIG. 3, fluid will be supplied as previously described from the pump 92 through the spool valve 90 and the pressure reducing spool valve 96.

In this state, the retract port 100 of the thumb cylinder 34 will sometimes demand fluid. Such make-up fluid is supplied through a check valve 124 which forms part of an anti-cavitation valve 126. Demand for fluid at the retract port 100 is caused by the bucket 24 pushing against the workpiece 46 and hence the thumb 34. The piston rod moves into the cylinder 34 and draws fluid into the retract port 100 from the tank 122 as required.

The controlled state described above is maintained indefinitely after a momentary pressing of the close button 42. This controlled state is terminated when the open button 44 is depressed. Depressing the open button 44 sends a signals to the reset input R of the relay 76. The relay 76 output is de-energized and the solenoid 82 on the solenoid controlled pilot valve 80 is also de-energized and stays de-energized. The flow of pilot pressure fluid through the solenoid controlled pilot valve 80 is interrupted and no fluid flows through the pressure control valve 84. This de-activates the pilot operated 3-way valve 120 and also de-energizes the first pilot input 94 of the pilot operated spool valve 90. De-energizing the pilot operated 3-way valve 120 interrupts communication between the drain 112 of the pilot relief valve 102 and the tank 122. The pilot relief valve 102 is effectively removed from the circuit and no longer controls the pressure reducing spool valve 96. A second pilot relief valve 130 is also connected to the control port 104 of the pressure reducing spool valve and is set to relieve at 5,000 psi. It is connected directly to tank 122. Thus, with the pilot operated 3-way valve 120 in the de-energized condition, the pressure reducing spool valve only relieves at 5,000 psi, essentially system high pressure. The pressure reducing function is turned off and the spool valve 96 simply passes fluid.

A poppet valve 132 is connected in parallel with the pressure reducing spool valve 96. The poppet within the poppet valve 132 has a small restricted passage 136 allowing flow of fluid through the poppet to a chamber 138 behind the poppet. A low pressure control port 134 connects the chamber 138 to tank when the 3-way valve 120 is deactivated. If pressure is applied at the main ports of the pressure reducing spool valve 96 and poppet valve 132, the pressure pushes the poppet back allowing bidirectional flow through the poppet valve 132 effectively bypassing the pressure reducing valve 96.

Operation of the open button 44 also energizes a solenoid 142 on a second solenoid controlled pilot valve 140. Pilot pressure fluid is thereby provided to the second adjustable pressure control valve 144. Controlled pressure pilot fluid flows to the second pilot input 146 on the pilot operated spool valve 90. In this configuration, the pilot operated spool valve 90 allows high pressure fluid from the pump 92 to flow to the retract port 100 of the thumb cylinder 34. The extend port 98 of the thumb cylinder 34 is connected through the pressure reducing spool valve 96 and the poppet valve 132 (which is open) to the low pressure tank 122. So long as the open button 44 is depressed, high pressure fluid flows from the pump 92 through the spool valve 90 to the retract port 100 and the thumb 32 is moved away from the bucket 24. Full system pressure is applied to the retract port 100. This movement continues only so long as the open button is depressed. When the open button is released, the second solenoid 142 is no longer energized and the spool valve returns to the central neutral position supplying high pressure to neither the extend port 98 nor the retract port 100. The system is quiescent.

The poppet valve 132 is a high capacity valve. In the preferred embodiment it has an 80 gallon per minute flow rating. This allows one to leave the pressure reducing spool valve 96 and other valves described herein in the circuit should one disconnect the thumb from the excavator and choose to use the pilot operated spool valve 90 to control other functions, cylinders or accessories. Flow through the pressure reducing spool valve 96 and the poppet valve 132 does not appreciably reduce output pressure or flow.

When the 3-way valve 120 is actuated by flow through the pressure control valve 84 the low pressure control port 134 is disconnected from the tank 122. High pressure fluid applied to the input of the poppet valve 132 flows through the passage in the poppet 136 and pressurizes the chamber 138. This pressurization along with the action of the biasing spring in the poppet valve 132 closes the poppet valve and effectively removes it from the circuit. This is the configuration in the thumb close state.

The solenoid controlled pilot valve 80, the second solenoid controlled pilot valve 140 and associated pressure control valves 84 and 144 are shown as a first valve assembly 150 in FIG. 2. This particular arrangement of the two solenoid control valves is conventional and often present on excavators. The anti-cavitation assembly 126 including the check valve 124 connecting the retract port 100 to tank is also often part of the conventional hydraulic circuits on an excavator. The anti-cavitation assembly provides over pressure relief and cavitation relief to any excavator accessory connected to the retract port 100. An identical anti-cavitation assembly 152 is provided for the line which would normally directly feed the extend port 98.

The pressure reducing spool valve 96, the pilot relief valve 102, the second pilot relief valve 130, the pilot operated 3-way valve 120, and the poppet valve 132 are shown as a second valve assembly 160. A manifold providing the interconnections and ports described above is created and cartridge valves or the like fulfilling the function of the valves described are then assembled to the manifold. The manifold is easily mounted to the excavator 10 and integrated into existing hydraulic systems.

The pump 92 is illustrated as a variable volume pump controllable through a pilot line 162. A second pilot line 164 in close proximity to the pump pilot line 162 is connected to the check valve 86. This allows connection of alternative accessories to the excavator hydraulic system. For instance, the bucket and thumb can be removed from an excavator and a hydraulically driven impact hammer substituted for the bucket and thumb. The bucket cylinder 30 and its associated controls are used to position the impact hammer. Hydraulic fluid to operate the hammer is provided by the pump 92 through the spool valve 90. The hydraulic hammer controls connect to the pump pilot line 162 and the control pilot line 164. With the thumb controls inoperative, fluid pressure in the second pilot line 164 will operate the check valve 86 to isolate the thumb control and allow the hammer controls to operate the pilot operated spool valve 90. In this configuration, the lack of output pressure from the pressure control valve 84 puts the poppet valve 132 and the pressure reducing spool valve 96 in bypass mode. Hydraulic fluid can flow from the pilot operated spool valve 90 to the ports 98, 100 to operate other accessories. There is no need to remove the controls for the thumb from the hydraulic circuitry of the excavator in order to use a different accessory.

Appropriate valves having appropriate capacities to implement the above-described embodiment are available from a number of sources. One source of appropriate valves is Integrated Hydraulics Limited having offices at Collins Road, Heathcote Industrial Estate, Warwick CV34 6TF, England. Integrated Hydraulics has a sales office in the United States at 7047 Spinach Drive, Mentor, Ohio. Appropriate valves for use in the preferred embodiment include the 7SP300 directional control valve, the poppet valve 132; 1DR Series relief valve, the pilot relief valves 102, 130; 1PAA95 pressure reducing spool valve 96; and, CP720, pilot operated 3-way valve 120. Other valves can of course be substituted to achieve other capacity and depending on availability.

Figure 5:
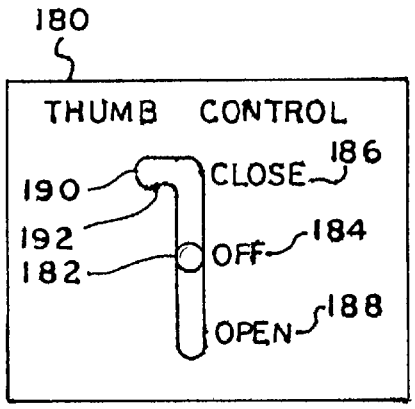

FIG. 5 shows an alternate control panel 180 for the thumb control. Rather than two electrical push buttons, a lever 182 provides all control. The lever 182 is spring loaded to the center off position 184. The lever 182 operates a 3-position one pole switch. This switch can be directly substituted for the buttons 42, 44 of FIG. 2. When the operator moves the lever 182 to the close position 186, a signal is sent to the S input of the relay 76 just as if the button 42 had been depressed. The lever 182 can be released but the close state will be held due to the latching action of the relay 76. The lever 182 can also be moved to the open position 188 which sends a signal to the R input of the latching relay 76 terminating the close state and operating the open solenoid 142. Just as with the thumb control open button 44, the lever 182 must be held in the open position to cause the thumb 32 to travel in the open direction. When the lever 182 is released, it springs back to the off 184 position and the control circuitry is quiescent. The lever 182 can also assume the off 184 position while the controls are still in the close mode.

Alternatively, the lever 182 and the switch of which it forms a part can include the latching function of the relay 76. In this configuration, the lever 182 is only spring biased to return from the open position 88 to the off position. When the lever 182 is pushed into the closed position, it is held there. This can be done with either mechanical controls in the switch associated with the lever (lack of a return spring) or it can be done with a side detent 190 as shown in FIG. 5. In this embodiment, the relay 76 is dispensed with. When an operator wishes to put the control system in the close mode, the lever 182 is pushed upwardly and to the left where the spring biasing will hold it in the slight dip 192 in the side detent 190. This holds the switch closed in the close position providing current to the solenoid 82 and maintaining the close state in the control system. The control system operates just as if the close button 42 had been depressed in the first described embodiment. When the operator wishes to open the thumb, the lever is simply moved out of the detent 190 and the spring bias carries it to the off position. The solenoid 82 is de-energized and pressure is no longer maintained at the extend port 98 of the cylinder 34. The operator may then move the lever 182 into to the open position and move the thumb in the open direction.

The above-described control system can also be achieved with an entirely hydraulic system. Assemblies such as the first valve assembly 150 including pilot operated control valves rather than solenoid operated control valves are available. The lever 182 of the control shown in FIG. 5 operates a directional control valve which supplies pilot pressure hydraulic fluid to a pilot operated valve assembly similar in operation to the first valve assembly 150. Latching is provided by the side detent 190. The control system of FIG. 2 in all other respects remains identical and operates in an identical manner. The control functions implemented above with hydraulic valves can also be performed electronically or electrically. In an excavator using electrical or microprocessor control systems, electrical components of microprocessor routines can be substituted for the valve described.

The method of using the control system described above is straight forward. The operator positions the bucket 24 adjacent a workpiece 46 to be moved and depresses the thumb close button 42 or moves the lever into the thumb close position 186. The thumb 32 closes upon the workpiece 46 automatically and holds the workpiece 46 against the bucket 24 even when the bucket is moved relative to the stick 22. The valves are sized to provide adequate flow of hydraulic fluid so the thumb 32 can always keep up with the bucket 24. Normally, bucket cylinders are larger than thumb cylinders and therefore require a greater flow than the thumb cylinder to move a given angular distance. The operator can move the boom 20, the stick 22, the cab 14, or the entire excavator 10 to position a workpiece 46 at a new location. Once positioned, the operator need only depress and hold down the open control (button or lever) to move the thumb 32 away from the workpiece 46 thereby allowing the bucket 24 and the entire excavator to disengage from the workpiece having completed its task.

The invention has been described with reference to preferred embodiments. Obviously, modifications and alterations will occur to others upon the reading and understanding of this specification and it is intended to include such modifications and alterations as they come within the scope of the appended claims or the equivalents thereof.

Having thus described the invention, it is so claimed:

1. A thumb control for a thumb on an excavator, said thumb adapted to engage a workpiece against a bucket, said thumb control comprising:

a thumb close switch;

a thumb close latch adapted to be set by said thumb close switch;

a thumb close valve adapted to provide pilot pressure fluid at an output when activated by a set signal from said latch;

a thumb control valve adapted to connect a source of high pressure hydraulic fluid to a thumb cylinder piston extend line and connect a reservoir of low pressure hydraulic fluid to a thumb cylinder piston retract line when activated by said thumb close valve;

a pressure limiter limiting pressure in said thumb cylinder piston extend line to a selected thumb cylinder close pressure limit;

a thumb open switch adapted to reset said thumb close latch:

a thumb open valve adapted to provide pilot pressure fluid at an output when activated by said thumb open switch; and, said thumb control valve further adapted to connect said source of high pressure hydraulic fluid to said thumb cylinder piston retract line and connect a reservoir of low pressure hydraulic fluid to said thumb cylinder piston extend line when activated by said thumb open valve.

2. The thumb control of claim 1, further comprising a bypass valve selectively bypassing said pressure limiter.

3. The thumb control of claim 2, wherein said bypass valve comprises a pilot operated poppet valve.

4. The thumb control of claim 3, wherein said thumb close valve output actuates a pilot operated 3-way valve which in turn closes said pilot operated poppet valve and enables said pressure limiter in a first state; and, opens said pilot operated poppet valve and disables said pressure limiter in a second state.

5. The thumb control of claim 4, wherein said thumb control valve is a pilot operated spool valve receiving input from said thumb close valve and said thumb open valve.

6. The thumb control of claim 5, further comprising a check valve between said thumb close valve output and said pilot operated spool valve whereby said spool valve may be operated by other control systems for other attachments.

7. The thumb control of claim 6, wherein said thumb close valve is solenoid operated and said thumb open valve is solenoid operated.

8. The thumb control of claim 1, wherein said thumb close switch and said thumb close latch are integrated into a single device.

9. A thumb control for a thumb on an excavator, said thumb being positioned by a thumb cylinder said thumb adapted to engage and retain a workpiece against a bucket; said thumb control comprising:

a thumb close switch;

a thumb close latch adapted to be set by said thumb close switch;

a thumb close valve adapted to provide fluid at an output when activated by a set signal from said latch;

a hydraulically operated thumb control valve adapted to connect a source of high pressure hydraulic fluid to a thumb cylinder piston extend line when activated by said thumb close valve;

a pressure limiter limiting pressure in said thumb cylinder piston extend line to a selected thumb close pressure limit;

a thumb open switch adapted to reset said thumb close latch;

a thumb open valve adapted to provide fluid at an output when activated by said thumb open switch; and, said thumb control valve further adapted to connect said source of high pressure hydraulic fluid to a thumb cylinder piston retract line when activated by said thumb open valve.

10. The thumb control of claim 9, further comprising a bypass valve selectively bypassing said pressure limiter.

11. The thumb control of claim 9, wherein said thumb control valve is a pilot operated spool valve receiving input from said thumb close valve and said thumb open valve.

12. The thumb control of claim 11, further comprising a check valve between said thumb close valve output and said pilot operated spool valve whereby said spool valve may be operated by other control systems for other attachments.

13. The thumb control of claim 9, wherein said thumb close valve is solenoid operated and said thumb open valve is solenoid operated.

14. A thumb control for a thumb on an excavator having a hydraulic system with a maximum system pressure, said thumb being positioned by a thumb cylinder having an extend port and a retract port, said thumb being adapted to engage a workpiece against a bucket, said thumb control comprising:

an operator actuable actuator means;

a close means directing hydraulic fluid to said extend port at a preselected thumb close pressure less than said maximum system pressure and maintaining said thumb close pressure;

an open means stopping the flow of hydraulic fluid to said extend port and directing hydraulic fluid to said retract port; and, said actuator means controlling said close means and said open means.

15. The thumb control of claim 14 further comprising bypass means allowing fluid to bypass said close means when said close means is not actuated.

16. In an excavator having a boom supporting an implement, a hydraulic system having a maximum system pressure, a thumb attachment adapted to close against said implement to grasp a workpiece, a thumb hydraulic cylinder acting on said thumb, the improvement comprising:

a hydraulic system supplying hydraulic fluid to said thumb hydraulic cylinder in the close direction such that said thumb closes against said workpiece and maintains a force against said workpiece, said hydraulic system supplying hydraulic fluid to said thumb cylinder up to a selected close pressure less than said system pressure and maintaining said selected close pressure until released.

17. The improved excavator of claim 16, wherein said selected close pressure is maintained regardless of said implement position or movement.

18. The improved excavator of claim 17, wherein said selected close pressure is released by an operator activating an open control.

19. A method of controlling a thumb on an excavator, said thumb being movably opposed to a movable implement, said implement being positioned by an implement cylinder, said thumb being positioned by a thumb cylinder having a piston fixed to said thumb, a piston extend port and a piston retract port comprising the following steps:

providing a thumb close latched manual control;

providing a thumb open manual control;

providing a source of hydraulic fluid at a high pressure;

providing a drain to low pressure hydraulic fluid;

providing a connection to hydraulic fluid at a selected pressure less than said high pressure to said thumb cylinder piston extend port and providing a connection to said drain to low pressure hydraulic fluid when said thumb close latched manual control is actuated;

maintaining said selected pressure at said piston extend port and said connection to said drain to low pressure hydraulic fluid regardless of thumb position while said thumb close latched manual control is latched; and, upon actuation of said thumb open manual control, unlatching said thumb close latched manual control, connecting said thumb cylinder piston extend port to said drain to low pressure, connecting said thumb cylinder retract port to said source of hydraulic fluid at high pressure.

* * * * *